US010283108B2

(12) United States Patent
Sugai et al.

(10) Patent No.: US 10,283,108 B2
(45) Date of Patent: May 7, 2019

(54) ACTIVE NOISE CONTROL DEVICE AND ERROR PATH CHARACTERISTIC MODEL CORRECTION METHOD

(71) Applicant: ALPINE ELECTRONICS, INC., Shinagawa-ku, Tokyo (JP)

(72) Inventors: Taku Sugai, Iwaki (JP); Nozomu Saito, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 0 days.

(21) Appl. No.: 15/920,086

(22) Filed: Mar. 13, 2018

(65) Prior Publication Data

US 2018/0308469 A1 Oct. 25, 2018

(30) Foreign Application Priority Data

Apr. 21, 2017 (JP) ..... 2017-084881

(51) Int. Cl.
*G10K 11/178* (2006.01)

(52) U.S. Cl.
CPC ..... *G10K 11/17881* (2018.01); *G10K 11/178* (2013.01); *G10K 11/17813* (2018.01); *G10K 11/17823* (2018.01); *G10K 11/17825* (2018.01); *G10K 11/17854* (2018.01); *G10K 2210/12822* (2013.01); *G10K 2210/3028* (2013.01);

(Continued)

(58) Field of Classification Search
CPC ..... G10K 11/1788; G10K 2210/3055; G10K 2210/1282; G10K 2210/3027; G10K 2210/128; G10K 2210/3221; G10K 2210/3053; G10K 2210/503; G10K 2210/506
See application file for complete search history.

(56) References Cited

U.S. PATENT DOCUMENTS 5,426,703 A 6/1995 Hamabe et al.
5,635,876 A * 6/1997 Gerrits ..... H03D 1/2254 327/236

(Continued)

FOREIGN PATENT DOCUMENTS

JP 2000-99037 4/2000
JP 2009-298288 12/2009

OTHER PUBLICATIONS

Extended European Search Report for 18160751.6 dated Oct. 18, 2018, 10 pgs.

(Continued)

*Primary Examiner* — Mohammad K Islam
(74) *Attorney, Agent, or Firm* — Brinks Gilson & Lione

(57) ABSTRACT

An error path characteristic model correction control unit determines the deviation of the phase of an actual transfer function from the phase of an error path characteristic model, from a cross correlation between an error signal output from a microphone and a signal in which the error path characteristic model is applied to a noise cancellation sound to be output and a cross correlation between the error signal and a signal in which a transfer function having a phase characteristic deviating by +90 degrees from the phase characteristic of the error path characteristic model is applied to the noise cancellation sound. The error path characteristic model correction control unit then corrects the error path characteristic model so that the determined deviation is reduced to ±90 degrees.

14 Claims, 5 Drawing Sheets

(52) U.S. Cl.
CPC ..... *G10K 2210/3044* (2013.01); *G10K 2210/3046* (2013.01); *G10K 2210/3055* (2013.01)

(56) References Cited

U.S. PATENT DOCUMENTS

| | | | | |
|---|---|---|---|---|
| 9,100,747 | B2 * | 8/2015 | Murata | H04R 1/1083 |
| 9,240,819 | B1 | 1/2016 | Ku | |
| 9,747,885 | B2 * | 8/2017 | Goto | G10K 11/17813 |
| 9,773,491 | B2 * | 9/2017 | Ku | G10K 11/178 |
| 9,824,678 | B1 * | 11/2017 | Ou | G10K 11/178 |
| 9,923,550 | B2 * | 3/2018 | Argyropoulos | H03H 21/0012 |
| 2003/0112980 | A1 * | 6/2003 | Vaishya | G10K 11/178 381/71.1 |
| 2004/0240678 | A1 * | 12/2004 | Nakamura | G10K 11/178 381/71.11 |
| 2005/0207585 | A1 * | 9/2005 | Christoph | G10K 11/178 381/71.11 |
| 2007/0172004 | A1 * | 7/2007 | Funayama | G10K 11/178 375/346 |
| 2009/0086990 | A1 * | 4/2009 | Christoph | H04R 3/04 381/71.12 |
| 2010/0272283 | A1 * | 10/2010 | Carreras | G10K 11/178 381/71.6 |
| 2011/0206214 | A1 * | 8/2011 | Christoph | G10K 11/178 381/71.6 |
| 2012/0093344 | A1 * | 4/2012 | Sun | H04R 3/005 381/122 |
| 2015/0010164 | A1 * | 1/2015 | Christoph | G10K 11/178 381/71.6 |
| 2016/0029124 | A1 * | 1/2016 | Paranjpe | H04M 9/082 381/71.14 |
| 2016/0300563 | A1 * | 10/2016 | Park | G10K 11/17853 |
| 2017/0077906 | A1 * | 3/2017 | Argyropoulos | H03H 21/0012 |
| 2017/0178617 | A1 * | 6/2017 | Christoph | G10K 11/17853 |
| 2017/0287462 | A1 * | 10/2017 | Christoph | B60N 2/879 |
| 2017/0301336 | A1 * | 10/2017 | Kumar | G10K 11/1788 |

OTHER PUBLICATIONS

Guldenschuh Markus: "Secondary-path models in adaptive-noise-control headphones", 3rd International Conference on Systems and Control, IEEE, Oct. 29, 2013 (Oct. 29, 2013), pp. 653-658.

Kim Benjamin et al.: "Linear independence 1-14 method for system identification/secondary path modeling for active control", The Journal of the Acoustical Society of America, American Institute of Physics for the Acoustical Society of America, New York, NY, US, vol. 118, No. 3, Jan. 1, 2005 (Jan. 1, 2005), pp. 1452-1468.

* cited by examiner

ACTIVE NOISE CONTROL DEVICE AND ERROR PATH CHARACTERISTIC MODEL CORRECTION METHOD

RELATED APPLICATION

The present application claims priority to Japanese Patent Application Number 2017-084881, filed Apr. 21, 2017, the entirety of which is hereby incorporated by reference.

BACKGROUND

1. Field of the Invention

The present invention relates to an active noise control (ANC) technology that emits a noise cancellation sound by which noise is cancelled.

2. Description of the Related Art

An ANC device known as an ANC technology that emits a noise cancellation sound by which noise is cancelled handles engine sounds of an automobile as noise and reduces an engine sound audible to occupants (see Japanese Unexamined Patent Application Publication No. 2000-099037, for example).

In a known method, this type of ANC device that reduces an engine sound has a speaker that emits a noise cancellation sound and a microphone placed in the vicinity of an occupant, the microphone being used as a remaining signal detecting means; the ANC device performs feed forward adaptive control in which an adaptive notch filter is used. Generally, when this type of system is constructed, a transfer function for a path, which is an error path, from the speaker to the microphone is measured in advance and a noise cancellation sound is generated according to a filtered-x least means square (LMS) algorithm, which is mounted as an error path characteristic model.

In this type of ANC device that reduces an engine sound, an actual error path characteristic changes due to time-dependent changes in the characteristics of the speaker and microphone as well as changes in an environment in the vehicle that are caused when, for example, a window is opened or closed or the number of occupants is increased or decreased. This causes a deviation from an error path characteristic model that has been set in advance, resulting in unstable control. In a known technology that corrects this deviation, a pseudo engine sound output from the speaker as a sound effect is used as an identification sound and an actual transfer function is measured to correct the error path characteristic model that has been set (see Japanese Unexamined Patent Application Publication No. 2009-298288, for example).

For the ANC device that reduces an engine sound, the above technology measures a pseudo engine sound as an identification sound to correct the error path characteristic model that has been set. Therefore, a special structure is needed to output a pseudo engine sound. Another problem with the technology is that only in a limited situation, the error path characteristic model can be correctly corrected without giving an uncomfortable feeling caused by the pseudo engine sound to occupants.

SUMMARY

The present disclosure addresses the above problems with the object of providing an ANC device that corrects an error path characteristic model used in a filtered-x LMS algorithm with a simpler structure, without giving an uncomfortable feeling to occupants.

To achieve the above object, in the present disclosure, an active noise control device that reduces noise is structured by including: a speaker that outputs a noise cancellation sound that cancels noise at a predetermined noise cancellation position; a reference signal generating means for generating a reference signal; a noise cancellation sound generating means having an adaptive filter that adjusts the phase and amplitude of the noise cancellation sound, the noise cancellation sound generating means being configured to generate the noise cancellation sound from the reference signal by using the adaptive filter; a microphone that picks up a combined sound generated by combining noise at the noise cancellation position and the noise cancellation sound and outputs the combined sound as an error signal; an error path characteristic model formed by numerically modeling a transfer function for an error path; a filtered reference signal generating means for generating a filtered reference signal from the reference signal through the error path characteristic model; an adaptive filter coefficient adjusting means for adjusting the adaptive filter coefficient of the adaptive filter so as to reduce the error signal by using the filtered reference signal and the error signal; a phase characteristic difference determining means for determining a difference in phase characteristic between the error path characteristic model and an actual error path between the speaker and the microphone; and an error path characteristic model correcting means for correcting the error path characteristic model according to the difference in phase characteristic, the difference being determined by the phase characteristic difference determining means, so that the difference in phase characteristic between the error path characteristic model and the actual error path is reduced.

Since this type of active noise control device handles noise in a sine wave form, the phase characteristic difference determining means may be structured so as to determine the difference in phase characteristic according to a first cross correlation that represents a correlation between the error signal and a first detection sound generated by applying, to the noise cancellation sound generated by the noise cancellation sound generating means, a transfer function having a phase characteristic differing by 90 degrees multiplied by n (n is an integer) from the phase characteristic of the error path characteristic model and to a second cross correlation that represents a correlation between the error signal and a second detection sound generated by applying, to the noise cancellation sound generated by the noise cancellation sound generating means, a transfer function having a phase characteristic differing by 90 degrees multiplied by (n+1) from the phase characteristic of a transfer function set in the noise cancellation sound generating means.

When the active noise control device is structured as described above, n is preferably 0, the first detection sound is preferably a sound in which the transfer function set in the noise cancellation sound generating means is applied to the noise cancellation sound generated by the noise cancellation sound generating means, and the second detection sound is preferably a sound in which a transfer function having a phase characteristic deviating by 90 degrees from the phase characteristic of the transfer function set in the noise cancellation sound generating means is applied to the noise cancellation sound generated by the noise cancellation sound generating means.

In the active noise control device described above, the error path characteristic model correcting means may perform a predetermined computation to correct the error path characteristic model by an increment of 90 degrees, according to the difference in phase characteristic, the difference being determined by the phase characteristic difference determining means. Alternatively, from models prepared in advance that have mutually different phase characteristics differing from the phase characteristic of the error path characteristic model in units of 90 degrees, the error path characteristic model correcting means may select the model having the smallest difference in phase characteristic between the models and the actual error path according to the difference in phase characteristic, the difference being determined by the phase characteristic difference determining means, and may correct the error path characteristic model to the model that has been selected.

In this case, the phase characteristic difference determining means in the active noise control device may determine a phase difference that is an increment of 90 degrees, according to a combination of whether the first cross correlation represents the absence of a correlation, a positive correlation, or a negative correlation and whether the second cross correlation represents the absence of a correlation, a positive correlation, or a negative correlation, the increment being determined by the combination.

The active noise control device described above may be mounted in an automobile and may reduce engine sounds of the automobile as the noise.

The active noise control device described above can correct an error path characteristic model according to an actual change in phase characteristic, without having to output an identification sound used to measure a transfer function such a pseudo engine sound. Therefore, it is possible to correct an error path characteristic model and achieve stable control, without giving an uncomfortable feeling, which would otherwise be caused by a sound used to correct the error path characteristic model and without needing a special structure to output a sound used to correct the error path characteristic model.

As described above, the ANC device in the present disclosure can correct an error path characteristic model used in a filtered-x LMS algorithm with a simpler structure, without giving an uncomfortable feeling to occupants.

DETAILED DESCRIPTION OF THE PREFERRED EMBODIMENTS

An embodiment of the present invention will be described below.

Figure 1:
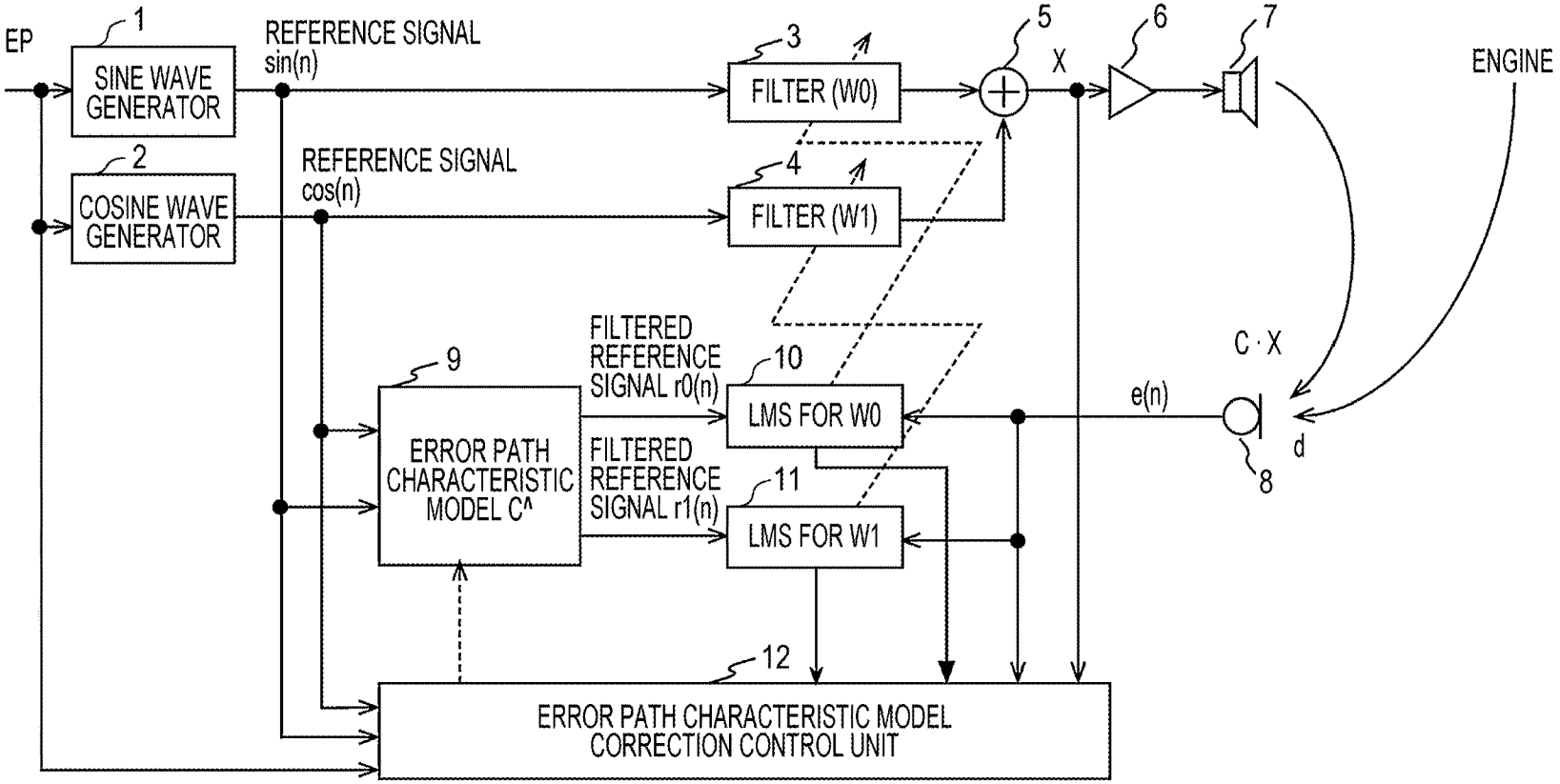
FIG. 1 is a block diagram illustrating the structure of an ANC device according to an embodiment of the present invention.

FIG. 1 illustrates the structure of an ANC device according to this embodiment. The ANC device according to this embodiment is mounted in an automobile. The ANC device handles engine sounds from the automobile as noise and reduces an engine sound audible to occupants.

As illustrated in the drawing, the ANC device has a sine wave generator 1 that generates a sine wave sin(n) synchronized with an engine pulse EP that is output in synchronization with the rotation of an engine, a cosine wave generator 2 that generates a cosine wave cos(n), which is $\pi/2$ radians out of phase with the sine wave generated by the sine wave generator 1, a filter (W0) 3 that performs convolution on the sine wave sin(n) with a selected filter coefficient W0 and produces an output, a filter (W1) 4 that performs convolution on the cosine wave cos(n) with a filter coefficient W1 and produces an output, an adder 5 that adds the output from the filter (W0) 3 and the output from the filter (W1) 4 and outputs the addition result as an adaptive filter output X, and an amplifier 6 that uses the output from the adder 5 to drive a speaker 7 and emits the adaptive filter output X.

The ANC device also has a structure described below to make the filter coefficient W0 of the filter (W0) 3 and the filter coefficient W1 of the filter (W1) 4 adaptive according to a filtered-x LMS algorithm.

That is, the ANC device has a microphone 8 placed in the vicinity of an occupant in the automobile. The microphone 8 picks up a sound C·X+d, which results from adding C·X and an engine sound d together, C·X being generated by applying an actual transfer function C from the adder 5 to the microphone 8 to the adaptive filter output X output from the adder 5. The microphone 8 then outputs the picked-up sound C·X+d as an error signal e(n).

The ANC device also has an error path characteristic model 9 (C^), which is a numerical model of the transfer function C to generate a filtered reference signal r0($n$) and a filtered reference signal r1($n$), in which an error path characteristic is reflected in the sine wave sin(n) and cosine wave cos(n). A relationship among the error path characteristic model 9 (C^), filtered reference signal r0($n$), and filtered reference signal r1($n$) is represented by equation (1) below.

$$\begin{bmatrix} r0(n) \\ r1(n) \end{bmatrix} = \begin{bmatrix} C\hat{}0 & -C\hat{}1 \\ C\hat{}1 & C\hat{}0 \end{bmatrix} \begin{bmatrix} \sin(n) \\ \cos(n) \end{bmatrix} \qquad \text{equation (1)}$$

The ANC device also has an LMS 10 for W0 that updates the filter coefficient W0 of the filter (W0) 3 and an LMS 11 for W1 that updates the filter coefficient W1 of the filter (W1) 4 according to equations (2) and (3) below.

The LMS 10 for W0 uses the reference signal r0($n$) output from the error path characteristic model 9 and the error signal e(n) output from the microphone 8 to update the filter coefficient W0 according to equation (2), which is W0($n$+1)=W0($n$)−μ·r0($n$)·e(n). In this equation, W0($n$) is the filter coefficient W0 before the update, W0($n$+1) is the filter coefficient W0 after the update, and μ is a predetermined parameter that stipulates a step size in the update.

Similarly, the LMS 11 for W1 uses the reference signal r1($n$) output from the error path characteristic model 9 and the error signal e(n) output from the microphone 8 to update the filter coefficient W1 according to equation (3), which is W1($n$+1)=W1($n$)−μ·r1($n$)·e(n). In this equation, W1($n$) is the filter coefficient W1 before the update, W1($n$+1) is the filter coefficient W1 after the update, and μ is a predetermined parameter that stipulates a step size in the update.

In the structure of the ANC device described above, if a phase difference between the error path characteristic model C^ and the actual transfer function C from the adder 5 to the microphone 8 is within a predetermined range, when the filter coefficient W0 and filter coefficient W1 are updated, the noise cancellation sound CX is automatically adjusted so that it has a phase opposite to the phase of the engine sound d at the position at which the microphone 8 is placed and cancels the engine sound d, reducing noise due to the engine sound d. In this embodiment, a phase change allowable range of the actual transfer function C in which the noise cancellation sound CX can be adjusted by updating the filter coefficient W0 and filter coefficient W1 so as to cancel the engine sound d is about ±90 degrees centered around the phase of the error path characteristic model C^.

If a phase difference between the error path characteristic model C^ and the actual transfer function C from the adder 5 to the microphone 8 exceeds the allowable range, even if the filter coefficient W0 and filter coefficient W1 are updated, it is not possible to cancel the engine sound d with the noise cancellation sound CX. In this case, the noise cancellation sound CX is excessively output.

In this embodiment, therefore, an error path characteristic model correction control unit 12 is provided so that even if a phase difference between the error path characteristic model C^ and the actual transfer function C from the adder 5 to the microphone 8 exceeds the allowable range, a correction can be made immediately.

A correction operation performed by the error path characteristic model correction control unit 12 described above will be described below.

First, to perform a correction, the error path characteristic model correction control unit 12 selects one of four models, C^[0], C^[−90], C^[+90] and C^[−180]. The error path characteristic model C^[0] is a model initialized to the error path characteristic model 9. C^[−90] is a model in which the phase of C^[0] deviates by −90 degrees. C^[+90] is a model in which the phase of C^[0] deviates by +90 degrees. C^[−180] is a model in which the phase of C^[0] deviates by −180 degrees.

When a primary transformation matrix represented by equation (1) is associated with C^[0], a relationship of the four models, C^[0], C^[−90], C^[+90] and C^[−180], having mutually different phase characteristics, is represented as follows. These models can be created by inversing signs and changing places.

$$C\hat{}[0] = \begin{bmatrix} A & -B \\ B & A \end{bmatrix} \qquad \text{equation (4)}$$

$$C\hat{}[+90] = \begin{bmatrix} B & A \\ -A & B \end{bmatrix}$$

$$C\hat{}[-90] = \begin{bmatrix} -B & -A \\ A & -B \end{bmatrix}$$

$$C\hat{}[-180] = \begin{bmatrix} A & B \\ -B & -A \end{bmatrix}$$

Figure 2:
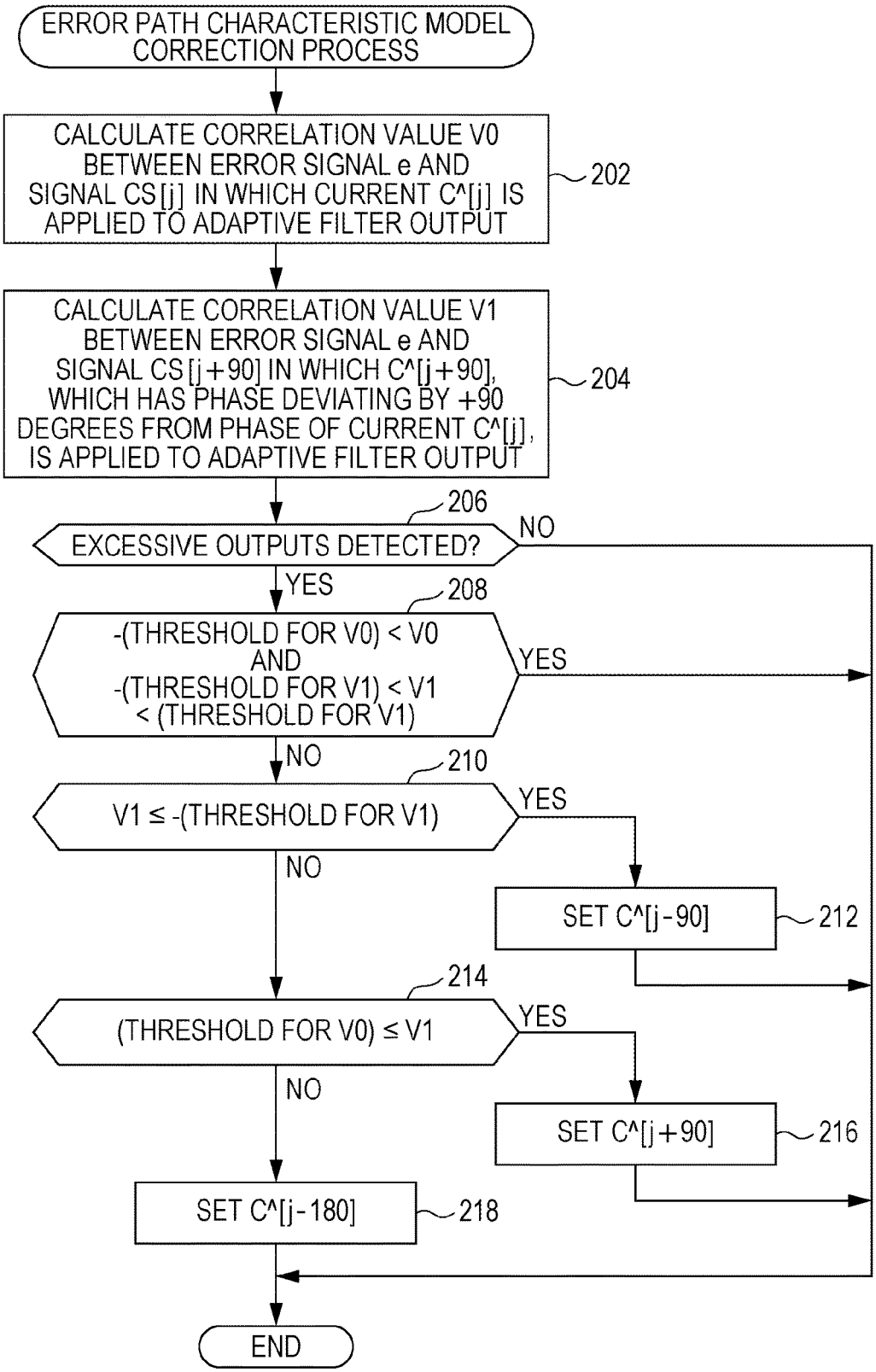
FIG. 2 is a flowchart illustrating an error path characteristic model correction process according to an embodiment of the present invention.

FIG. 2 illustrates a procedure for a correction process performed by the error path characteristic model correction control unit 12. The error path characteristic model correction process is periodically performed by the error path characteristic model correction control unit 12 at intervals of a predetermined cycle.

As illustrated in the drawing, in the error path characteristic model correction process, the error path characteristic model correction control unit 12 first calculates a cross correlation V0 between the error signal e(n) output from the microphone 8 and a signal CS[j] equivalent to a sound in which C^[j], which is a model currently selected from the four models, C^[0], C^[−90], C^[+90] and C^[−180], is applied to the adaptive filter output X (step 202).

The error path characteristic model correction control unit 12 also calculates a cross correlation V1 between the error signal e(n) output from the microphone 8 and a signal CS[j+90] equivalent to a sound in which C^[j+90], which has a phase characteristic deviating by +90 degrees from the phase characteristic of currently selected C^[j], is applied to the adaptive filter output X (step 204).

In practice, the error path characteristic model correction control unit 12 preferably performs calculation of the cross correlation V0 in step 202 and calculation of the cross correlation V1 in step 204 concurrently.

The signal CS[j] used in step 202 is calculated, in the error path characteristic model correction control unit 12, by performing a filter process on the adaptive filter output X output from the adder 5, the filter process giving a frequency response equivalent to a transfer characteristic represented by C^[j]. The signal CS[j+90] used in step 204 is calculated, in the error path characteristic model correction control unit 12, by performing a filter process on the adaptive filter output X output from the adder 5, the filter process giving a frequency response equivalent to a transfer characteristic represented by C^[j+90].

However, the signal CS[j] and the signal CS[j+90] may be created by providing the error path characteristic model correction control unit 12 with a signal CS[j] generating block that generates the signal CS[j] from the sine wave sin(n) output from the sine wave generator 1 and the cosine wave cos(n) output from the cosine wave generator 2 and a signal CS[j+90] generating block that generates the signal CS[j+90] from the sine wave sin(n) output from the sine wave generator 1 and the cosine wave cos(n) output from the cosine wave generator 2.

Figure 3A:
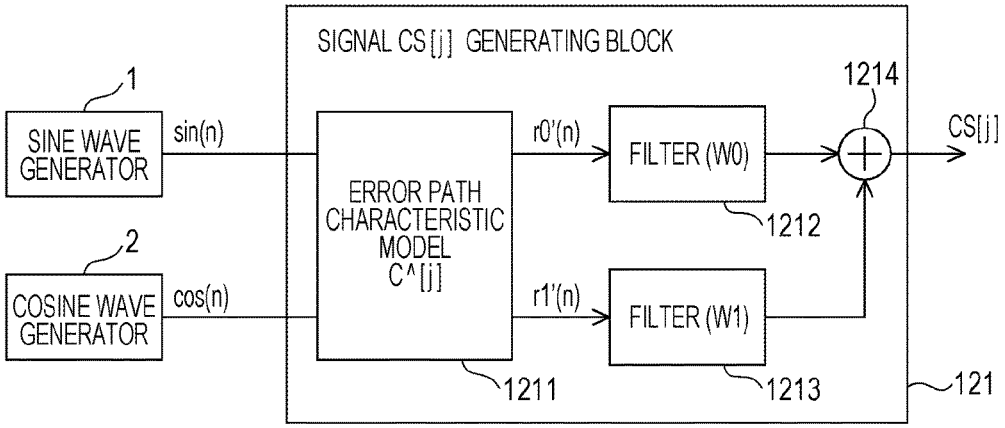
FIGS. 3A and 3B are each a block diagram illustrating the structure of a signal generating block according to an embodiment of the present invention.

As illustrated in FIG. 3A, the signal CS[j] generating block 121 includes: an error path characteristic model 1211 that outputs a reference signal r0'(*n*) by applying the error path characteristic C^[j] to the sine wave sin(n) output from the sine wave generator 1, and also outputs a reference signal r1'(*n*) by applying the error path characteristic C^[j] to the cosine wave cos(n) output from the cosine wave generator 2, according to equation (1) described above; a filter (W0) 1212 in which the same filter coefficient as the filter coefficient W0 that is currently set in the filter (W0) 3 is set and that convolutes the filter coefficient W0 into the reference signal r0'(*n*) and produces an output; a filter (W1) 1213 in which the same filter coefficient as the filter coefficient W1 that is currently set in the filter (W1) 4 is set and that convolutes the filter coefficient W1 into the reference signal r1'(*n*) and produces an output; and an adder 1214 that adds the output from the filter (W0) 1212 and the output from the filter (W1) 1213 and outputs the addition result as the signal CS[j].

Figure 3B:
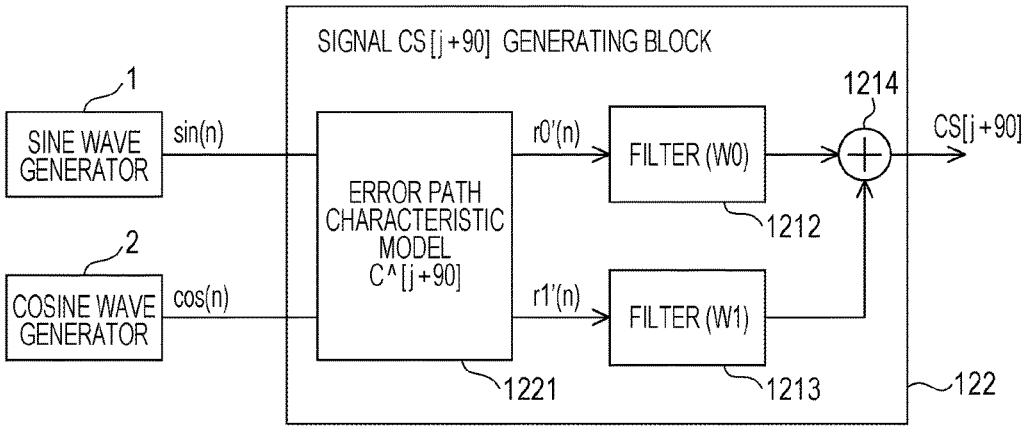

As illustrated in FIG. 3B, the structure of the signal CS[j+90] generating block 122 is equivalent to a structure in which the error path characteristic model 1211 in the signal CS[j] generating block 121 illustrated in FIG. 3A is replaced with an error path characteristic model 1221. The error path characteristic model 1221 outputs a reference signal r0'(*n*) by applying the error path characteristic C^[j+90] to the sine wave sin(n) output from the sine wave generator 1, and also outputs a reference signal r1'(*n*) by applying the error path characteristic Cˆ[j+90] to the cosine wave cos(n) output from the cosine wave generator 2.

Figure 4:
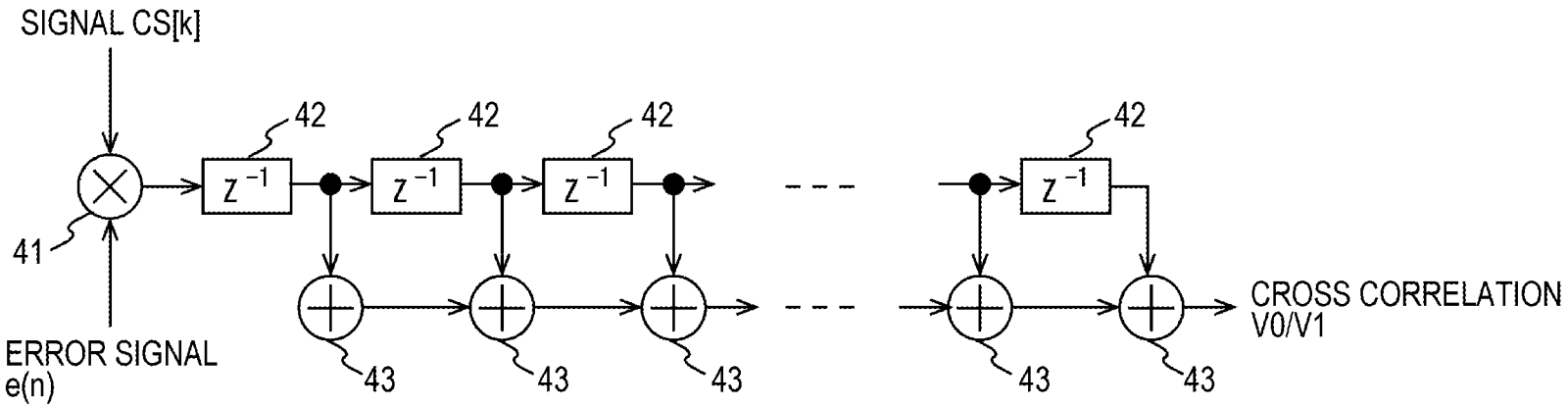
FIG. 4 illustrates the structure of a correlation calculating block according to an embodiment of the present invention.

Calculation, in steps 202 and 204, of a cross correlation between the error signal e(n) and a signal CS[k] (k is j or j+90) can be performed by, for example, providing the error path characteristic model correction control unit 12 with a correlation calculating block as illustrated in FIG. 4. As illustrated in the drawing, this correlation calculating block uses a multiplier 41, a plurality of delay units 42, and a plurality of adders 43 to integrate a value obtained by multiplying the signal CS[k] by the error signal e(n) for one cycle of the signal CS[k]. The correlation calculating block then outputs the integration result as the cross correlation V0 (when k is j) or the cross correlation V1 (when k is j+90).

Referring again to FIG. 2, after the cross correlation V0 and the cross correlation V1 have been calculated as described above (steps 202 and 204), the error path characteristic model correction control unit 12 checks whether the noise cancellation sound CX has been excessively output (step 206). If the noise cancellation sound CX has not been excessively output (the result in step 206 is No), the error path characteristic model correction control unit 12 terminates the correction process immediately.

To check whether the noise cancellation sound CX has been excessively output, the error path characteristic model correction control unit 12 checks the divergence of the filter coefficient W0 of the filter (W0) 3 due to the update of the LMS 10 for W0 and the divergence of the filter coefficient W1 of the filter (W1) 4 due to the update of the LMS 11 for W1. However, the error path characteristic model correction control unit 12 can also directly detect frequent outputs of the noise cancellation sound CX from itself.

If the noise cancellation sound CX has been excessively output (the result in step 206 is Yes), the error path characteristic model correction control unit 12 checks whether it is represented that V0 is larger than −(threshold for V0) and V1 is larger than −(threshold for V1) and smaller than (threshold for V1) (step 208). If it is represented that V0 is larger than −(threshold for V0) and V1 is larger than −(threshold for V1) and smaller than (threshold for V1) (the result in step 208 is Yes), the error path characteristic model correction control unit 12 terminates the correction process immediately.

If it is represented that V0 is larger than −(threshold for V0) and V1 is larger than −(threshold for V1) and smaller than (threshold for V1) as described above, this represents a case in which the error signal e(n) is 0 and noise attributable to engine sounds has been successfully reduced, that is, a case in which the error path characteristic model 9 is appropriate at present. In this case, the error path characteristic model correction control unit 12 does correct the error path characteristic model 9.

If it is not represented that V0 is larger than −(threshold for V0) and V1 is larger than −(threshold for V1) and smaller than (threshold for V1) (the result in step 208 is No), the error path characteristic model correction control unit 12 checks whether it is represented that −(threshold for V1) is equal to or larger than V1 (step 210). If it is represented that −(threshold for V1) is equal to or larger than V1 (the result in step 210 is Yes), this represents that the real transfer function deviates by −90 degrees from currently set Cˆ[j]. Therefore, the error path characteristic model correction control unit 12 changes (corrects) the error path characteristic model 9 to Cˆ[j−90] having a phase characteristic deviating by −90 degrees (step 212), and then terminates the error path characteristic model correction process.

If it is represented that −(threshold for V1) is equal to or larger than V1 as described above, it can be thought that a remaining component caused by the inability to cancel the engine sound d with the noise cancellation sound CX appears as a negative correlation of the cross correlation V0 and a remaining component caused by the inability to cancel the noise cancellation sound CX with the engine sound d appears as a negative correlation of the cross correlation V1. The negative correlation represented by the cross correlation V1 represents that the phase of the remaining component caused by the inability to cancel the noise cancellation sound CX with the engine sound d is near a phase opposite to the phase of the signal CS[j+90]. Therefore, it can be determined that a difference in phase characteristic between the actual transfer function C and the error path characteristic model 9 is about −90 degrees. In this case, therefore, the error path characteristic model correction control unit 12 changes the error path characteristic model 9 to Cˆ[j−90].

If it is not represented that −(threshold for V1) is equal to or larger than V1 (the result in step 210 is No), the error path characteristic model correction control unit 12 checks whether it is represented that V1 is equal to or larger than (threshold for V0) (step 214). If it is represented that V1 is equal to or larger than (threshold for V0) (the result in step 214 is Yes), the real transfer function deviates by +90 degrees from currently set Cˆ[j]. Therefore, the error path characteristic model correction control unit 12 changes (corrects) the error path characteristic model 9 to Cˆ[j+90] having a phase characteristic deviating by +90 degrees (step 216), and then terminates the error path characteristic model correction process.

If it is represented that V1 is equal to or larger than (threshold for V0) as described above, it can be thought that a remaining component caused by the inability to cancel the engine sound d with the noise cancellation sound CX appears as a negative correlation of the cross correlation V0 and a remaining component caused by the inability to cancel the noise cancellation sound CX with the engine sound d appears as a positive correlation of the cross correlation V1. The positive correlation represented by the cross correlation V1 represents that the phase of the remaining component caused by the inability to cancel the noise cancellation sound CX with the engine sound d is near a phase opposite to the phase of the signal CS[j+90]. Therefore, it can be determined that a difference in phase characteristic between the actual transfer function C and the error path characteristic model 9 is about +90 degrees. In this case, therefore, the error path characteristic model correction control unit 12 changes the error path characteristic model 9 to Cˆ[j+90].

If it is not represented that V1 is equal to or larger than (threshold for V0) (the result in step 210 is No) and the cross correlation V1 does not represent a positive correlation (the result in step 214 is No), it is found that the cross correlation V0 represents a negative correlation and the cross correlation V1 represents that there is no correlation, indicating that the real transfer function deviates by −180 degrees from currently set Cˆ[j]. Therefore, the error path characteristic model correction control unit 12 changes (corrects) the error path characteristic model 9 to Cˆ[j−180] having a phase characteristic deviating by −180 degrees (step 218) and then terminates the error path characteristic model correction process.

If the cross correlation V0 represents a negative correlation and the cross correlation V1 represents that there is no correlation as described above, it can be thought that the noise cancellation sound CX and engine sound d are in phase with each other and they appear as a negative correlation of the cross correlation V0. Since the noise cancellation sound CX and engine sound d have a phase opposite to the phase of the signal CS[j], it can be determined that a difference in phase characteristic between the actual transfer function C and the error path characteristic model 9 is about −180 degrees. In this case, therefore, the error path characteristic model correction control unit 12 changes the error path characteristic model 9 to Cˆ[j−180].

So far, the error path characteristic model correction process performed by the error path characteristic model correction control unit 12 has been described. An example of this error path characteristic model correction process will be described below.

Figure 5A:
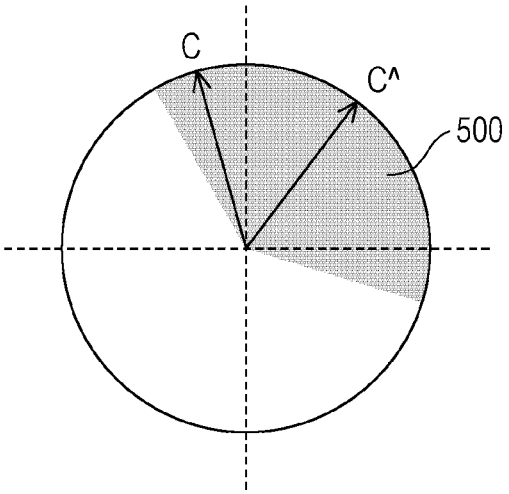
FIGS. 5A to 5C illustrate examples of a process in the error path characteristic model correction process according to the embodiment of the present invention.

Now, it is assumed that when the phase of Cˆ set in the error path characteristic model 9 is as illustrated in FIG. 5A, if the phase of the actual transfer function C is included in a phase range 500 of 90 degrees or less centered around the phase of Cˆ, the phase range 500 being grayed, the filter coefficient W0 and filter coefficient W1 are updated according to a filtered-x LMS algorithm and the noise cancellation sound CX can be adjusted so as to cancel the engine sound d.

If the phase of the actual transfer function C is within the phase range 500, an error signal e becomes 0, both of the cross correlations V0 and V1 represent that there is no correlation, so Cˆ is not changed.

If, for example, the phase of the actual transfer function C falls outside the phase range 500, a deviation in phase between Cˆ and the actual transfer function C is determined to be close to which of +90 degrees, −90 degrees, and −180 degrees according to the cross correlations V0 and V1, as described above. The phase of Cˆ is then changed to an area of the phase to which the deviation is determined to be close.

Figure 5B:
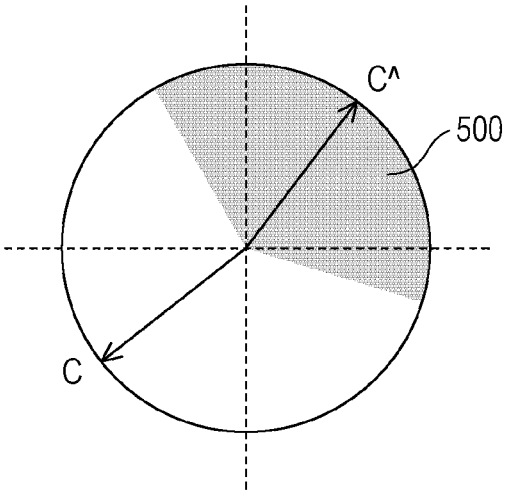
Figure 5C:
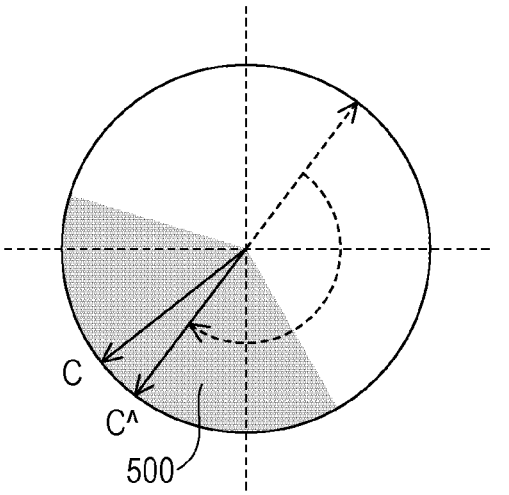

Specifically, if, for example, a difference in phase between Cˆ and the actual transfer function C is a value close to −180 degrees as illustrated in FIG. 5B, the deviation in phase between Cˆ and the actual transfer function C is determined to be close to −180 degrees according to the cross correlations V0 and V1. The phase of Cˆ is then changed by −180 degrees as illustrated in FIG. 5C.

As a result, the phase of the actual transfer function C falls within the phase range 500 centered around the phase of Cˆ, after which the filter coefficient W0 and filter coefficient W1 are updated according to the filtered-x LMS algorithm. The noise cancellation sound CX becomes adjustable so as to cancel the engine sound d.

This completes the description of the embodiment of the present invention. According to this embodiment, as described above, it is possible to correct the error path characteristic model 9, which is used to generate a noise cancellation sound, according to a change in the phase characteristic of the actual transfer function C, without having to output a special sound, such as a pseudo engine sound, used to correct the error path characteristic model 9. Therefore, the error path characteristic model 9, which is used in the filtered-x LMS algorithm, can be corrected, without giving an uncomfortable feeling, which would otherwise be caused by a sound used to correct the error path characteristic model 9 and without needing a special structure to output a sound used to correct the error path characteristic model 9.

In the error path characteristic model correction process in the above embodiment, the signal CS[j] equivalent to a sound in which Cˆ[j] is applied to the adaptive filter output X, Cˆ[j] being an initial setting in the error path characteristic model 9, and the signal CS[j+90] equivalent to a sound in which Cˆ[j+90] is applied to the adaptive filter output X have been used to determine a difference in phase between the error path characteristic model 9 and the actual transfer function C. However, this is not a limitation. Assuming that any value of 0, −90, +90, and −180 is k, the signal CS[k] equivalent to a sound in which Cˆ[k] is applied to the adaptive filter output X and the signal CS[k+90] equivalent to a sound in which Cˆ[k+90] is applied to the adaptive filter output X may be used to determine a difference in phase between the error path characteristic model 9 and the actual transfer function C. In this case, k may be a fixed value instead of depending on the error path characteristic model 9.

Even in this case, it is possible to determine the difference of the phase characteristic of the actual transfer function C from the phase characteristic of the error path characteristic model 9, from a difference in phase between Cˆ[k] and Cˆ[j], a correlation between the signal CS[k] and the error signal e, and a correlation between the signal CS[k+90] and the error signal e.

In the above embodiment, as means for correcting the error path characteristic model 9, a +90-degree correction mode, a −90-degree correction mode, and a −180-degree correction mode may be prepared with respect to an initial setting. According to a difference in phase between the error path characteristic model Cˆ and the actual transfer function C from the adder 5 to the microphone 8, a correction means for shifting to the relevant mode may be used. In this case, each time a shift to a mode is made, correction computation is performed by exchanging matrix elements of the model. Alternatively, an additional delay unit may be prepared and phase correction may be performed directly on a filtered reference signal. In this case, the signal CS[j] and signal CS[j+90] used to obtain cross correlations in the relevant mode are also exchanged with respect to the mode.

The above structure to correct the error path characteristic model 9 in the ANC device can also be similarly applied to reduce noise other than engine sounds.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. An active noise control device that reduces noise, the device comprising:

a speaker that outputs a noise cancellation sound that cancels noise at a predetermined noise cancellation position;

a reference signal generating means for generating a reference signal;

a noise cancellation sound generating means having an adaptive filter that adjusts a phase and amplitude of the noise cancellation sound, the noise cancellation sound generating means being configured to generate the noise cancellation sound from the reference signal by using the adaptive filter;

a microphone that picks up a combined sound generated by combining noise at the noise cancellation position and the noise cancellation sound and outputs the combined sound as an error signal;

an error path characteristic model formed by numerically modeling a transfer function for an error path;

a filtered reference signal generating means for generating a filtered reference signal from the reference signal through the error path characteristic model;

an adaptive filter coefficient adjusting means for adjusting an adaptive filter coefficient of the adaptive filter so as to reduce the error signal by using the filtered reference signal and the error signal;

a phase characteristic difference determining means for determining a difference in phase characteristic between the error path characteristic model and an actual error path between the speaker and the microphone; and an error path characteristic model correcting means for correcting the error path characteristic model according to the difference in phase characteristic, the difference being determined by the phase characteristic difference determining means, so that the difference in phase characteristic between the error path characteristic model and the actual error path is reduced.

2. The active noise control device according to claim 1, wherein since the active noise control device handles noise in a sine wave form, the phase characteristic difference determining means determines the difference in phase characteristic according to a first cross correlation that represents a correlation between the error signal and a first detection sound generated by applying, to the noise cancellation sound generated by the noise cancellation sound generating means, a transfer function having a phase characteristic differing by 90 degrees multiplied by n (n is an integer) from the phase characteristic of the error path characteristic model and to a second cross correlation that represents a correlation between the error signal and a second detection sound generated by applying, to the noise cancellation sound generated by the noise cancellation sound generating means, a transfer function having a phase characteristic differing by 90 degrees multiplied by (n+1) from a phase characteristic of a transfer function set in the noise cancellation sound generating means.

3. The active noise control device according to claim 2, wherein:

n is 0; and the first detection sound is a sound in which the transfer function set in the noise cancellation sound generating means is applied to the noise cancellation sound generated by the noise cancellation sound generating means, and the second detection sound is a sound in which a transfer function having a phase characteristic deviating by 90 degrees from the phase characteristic of the transfer function set in the noise cancellation sound generating means is applied to the noise cancellation sound generated by the noise cancellation sound generating means.

4. The active noise control device according to claim 3 wherein the error path characteristic model correcting means performs a predetermined computation to correct the error path characteristic model by an increment of 90 degrees, according to the difference in phase characteristic, the difference being determined by the phase characteristic difference determining means.

5. The active noise control device according to claim 3 wherein from models prepared in advance that have mutually different phase characteristics differing from the phase characteristic of the error path characteristic model in units of 90 degrees, the error path characteristic model correcting means selects the model having the smallest difference in phase characteristic between the models and the actual error path according to the difference in phase characteristic, the difference being determined by the phase characteristic difference determining means, and corrects the error path characteristic model to the model that has been selected.

6. The active noise control device according to claim 5 wherein the phase characteristic difference determining means determines a phase difference that is an increment of 90 degrees, according to a combination of whether the first cross correlation represents an absence of a correlation, a positive correlation, or a negative correlation and whether the second cross correlation represents an absence of a correlation, a positive correlation, or a negative correlation, the increment being determined by the combination.

7. The active noise control device according to claim 6 wherein the active noise control device is mounted in an automobile and reduces an engine sound of the automobile as the noise.

8. An error path characteristic model correction method that corrects, in an active noise control device that has a speaker that outputs a noise cancellation sound that cancels noise at a predetermined noise cancellation position, a reference signal generating means for generating a reference signal, a noise cancellation sound generating means having an adaptive filter that adjusts a phase and amplitude of the noise cancellation sound, the noise cancellation sound generating means being configured to generate the noise cancellation sound from the reference signal by using the adaptive filter, a microphone that picks up a combined sound generated by combining noise at the noise cancellation position and the noise cancellation sound and outputs the combined sound as an error signal, an error path characteristic model formed by numerically modeling a transfer function for an error path, a filtered reference signal generating means for generating a filtered reference signal from the reference signal through the error path characteristic model, and an adaptive filter coefficient adjusting means for adjusting an adaptive filter coefficient of the adaptive filter so as to reduce the error signal by using the filtered reference signal and the error signal, the error path characteristic model correction method comprising:

a phase characteristic difference determining step for determining a difference in phase characteristic between the error path characteristic model in the active noise control device and an actual error path between the speaker and the microphone; and an error path characteristic model correcting step in which the active noise control device corrects the error path characteristic model according to the difference in phase characteristic, the difference being determined in the phase characteristic difference determining step, so that the difference in phase characteristic between the error path characteristic model and the actual error path is reduced.

9. The error path characteristic model correction method according to claim 8, wherein, in the phase characteristic difference determining step, the difference in phase characteristic is determined according to a first cross correlation that represents a correlation between the error signal and a first detection sound generated by applying, to the noise cancellation sound generated by the noise cancellation sound generating means, a transfer function having a phase characteristic differing by 90 degrees multiplied by n (n is an integer) from the phase characteristic of the error path characteristic model and to a second cross correlation that represents a correlation between the error signal and a second detection sound generated by applying, to the noise cancellation sound generated by the noise cancellation sound generating means, a transfer function having a phase characteristic differing by 90 degrees multiplied by (n+1) from the phase characteristic of the error path characteristic model.

10. The error path characteristic model correction method according to claim 9, wherein the first detection sound is a sound in which the error path characteristic model is applied to the noise cancellation sound generated by the noise cancellation sound generating means, and the second detection sound is a sound in which a transfer function having a phase characteristic deviating by 90 degrees from the phase characteristic of the error path characteristic model is applied to the noise cancellation sound generated by the noise cancellation sound generating means.

11. The error path characteristic model correction method according to claim 10, wherein, in the error path characteristic model correcting step, a predetermined computation is performed to correct the error path characteristic model by an increment of 90 degrees, according to the difference in phase characteristic, the difference being determined in the phase characteristic difference determining step.

12. The error path characteristic model correction method according to claim 10, wherein, in the error path characteristic model correcting step, from models prepared in advance that have mutually different phase characteristics differing from the phase characteristic of the error path characteristic model in units of 90 degrees, the model having the smallest difference in phase characteristic between the models and the actual error path is selected according to the difference in phase characteristic, the difference being determined in the phase characteristic difference determining step, after which the error path characteristic model is corrected to the model that has been selected.

13. The error path characteristic model correction method according to claim 12, wherein, in the phase characteristic difference determining step, a phase difference that is an increment of 90 degrees is determined according to a combination of whether the first cross correlation represents an absence of a correlation, a positive correlation, or a negative correlation and whether the second cross correlation represents an absence of a correlation, a positive correlation, or a negative correlation, the increment being determined by the combination.

14. The error path characteristic model correction method according to claim 13, wherein the active noise control device is mounted in an automobile and reduces an engine sound of the automobile as the noise.

* * * * *